US009661891B2

(12) United States Patent
Dowling et al.

(10) Patent No.: US 9,661,891 B2
(45) Date of Patent: May 30, 2017

(54) HELMET VISOR

(71) Applicant: Revision Military S.a.r.L., Luxembourg (LU)

(72) Inventors: Brian Dowling, Milton, VT (US); Edward R. Hall, Starksboro, VT (US)

(73) Assignee: Revision Military S.a.r.L., Luxembourg (LU)

( * ) Notice: Subject to any disclaimer, the term of this patent is extended or adjusted under 35 U.S.C. 154(b) by 0 days.

(21) Appl. No.: 14/726,951

(22) Filed: Jun. 1, 2015

(65) Prior Publication Data

US 2015/0366284 A1 Dec. 24, 2015

Related U.S. Application Data

(60) Provisional application No. 62/014,563, filed on Jun. 19, 2014.

(51) Int. Cl.

| | |
|---|---|
| ***A42B 1/08*** | (2006.01) |
| ***A42B 3/22*** | (2006.01) |
| ***A42B 3/08*** | (2006.01) |
| ***F41H 1/04*** | (2006.01) |

(52) U.S. Cl.

CPC ..... *A42B 3/228* (2013.01); *A42B 3/08* (2013.01); *A42B 3/222* (2013.01); *F41H 1/04* (2013.01)

(58) Field of Classification Search

CPC .. A42B 3/04; A42B 3/228; A42B 3/08; A42B 3/222; A42B 3/20; A61F 9/064

USPC ..... 2/422, 6.3, 6.4, 6.6, 8.2, 8.5, 424, 9, 2.5

See application file for complete search history.

(56) References Cited

U.S. PATENT DOCUMENTS

| | | | | | |
|---|---|---|---|---|---|
| 2,105,028 | A | * | 1/1938 | Dickhoff | A42B 3/22 2/421 |
| 2,973,522 | A | | 3/1961 | Edwards et al. | |
| 3,475,766 | A | | 11/1969 | Raschke | |
| 3,707,004 | A | | 12/1972 | Kapitan et al. | |
| 3,991,421 | A | * | 11/1976 | Stratten | F41H 1/00 2/2.5 |
| 4,475,248 | A | * | 10/1984 | L'Abbe | A42B 3/063 2/2.5 |
| 4,853,973 | A | * | 8/1989 | Boochard | A61F 9/06 2/434 |
| 5,005,926 | A | * | 4/1991 | Spielberger | G02B 5/285 359/359 |
| 5,086,515 | A | * | 2/1992 | Giuliano | A61F 9/06 2/8.1 |
| 5,251,333 | A | | 10/1993 | Tsook | |
| 5,996,125 | A | * | 12/1999 | Garzone | A42B 3/227 2/10 |

(Continued)

FOREIGN PATENT DOCUMENTS

| | | |
|---|---|---|
| WO | WO 2004/084664 A2 | 10/2004 |
| WO | WO 2011/028966 A2 | 3/2011 |

OTHER PUBLICATIONS

International Search Report and Written Opinion for PCT/IB2015/001607 mailed Nov. 13, 2015.

(Continued)

*Primary Examiner* — Tejash Patel

(74) *Attorney, Agent, or Firm* — Wolf, Greenfield & Sacks, P.C.

(57) ABSTRACT

Helmet systems and their methods of use are described. In one embodiment, an opaque, ballistic rated visor is attached to a helmet such that the visor covers a wearer's eyes.

32 Claims, 3 Drawing Sheets

(56) References Cited

U.S. PATENT DOCUMENTS

| | | | | |
|---|---|---|---|---|
| 7,431,453 | B2 * | 10/2008 | Hogan | A61F 9/025<br>351/158 |
| 7,900,268 | B2 * | 3/2011 | Mahan | A42B 3/20<br>2/10 |
| 8,436,788 | B2 | 5/2013 | Kier et al. | |
| 8,814,266 | B2 * | 8/2014 | Guering | B64D 11/06<br>297/216.12 |
| 2009/0000015 | A1 | 1/2009 | Ahn et al. | |

OTHER PUBLICATIONS

U.S. Dept. of Justice, "Ballistic Resistance of Body Armor," NIJ Standard—0101.06 (Jul. 2008).

* cited by examiner

HELMET VISOR

CROSS-REFERENCE TO RELATED APPLICATIONS

This application claims the benefit under 35 U.S.C. §119 (e) of U.S. Provisional application Ser. No. 62/014,563, filed Jun. 19, 2014, the disclosure of which is incorporated by referenced in its entirety.

FIELD

Embodiments disclosed herein are related to helmet visors and helmets with visors.

BACKGROUND

Those who are at risk of exposure to trauma to the head (e.g., soldiers, emergency responders, law enforcement officers, military personnel, etc.) may wear protective headgear, such as a helmet. In some cases, it may be desirable for helmets to include an accessory, such as a carrier, front mount, rail mount, illuminator, camera, video recorder, laser pointer, communications device, identification friend or foe (IFF) device, optical system, or other item(s), to aid the helmet wearer in the performance of duties while in the field.

SUMMARY

In one embodiment, a helmet system includes an opaque, ballistic rated visor constructed and arranged to be attached to a helmet such that the visor covers a wearer's eyes when attached to the helmet.

In another embodiment, a method includes attaching an opaque ballistic rated visor to a helmet where the visor covers a wearer's eyes when attached to the helmet.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
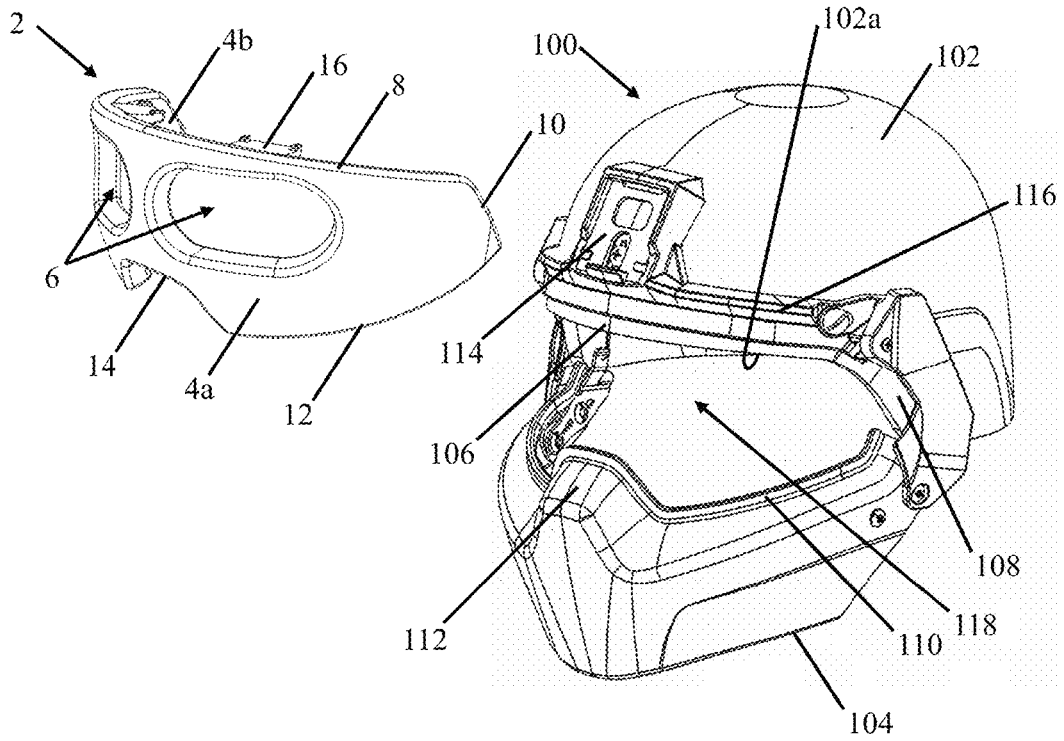
FIG. 1 is a schematic, perspective, and exploded view of a visor and associated helmet assembly according to one embodiment.

Current optically transparent visors used for combat helmets do not necessarily offer a level of protection desired for certain situations, primarily because of the materials used to construct transparent visors. Specifically, the materials used in these transparent visors do not include the various types materials used in armors that provide higher levels of threat protection. For example, optically transparent visors typically offer protection against National Institute of Justice (NIJ) threat levels I and II associated with small arms. However, these optically transparent visors do not typically offer protection against NIJ threat levels III and IV. Armor associated with protection against NIJ threat levels III and IV typically uses opaque ballistic plates in combination with other materials to provide such protection.

In view of the above, the present disclosure provides a ballistic rated visor for use with a combat helmet, where the visor is capable of providing protection against threat levels I, IIA, II, IIIA, III, and/or IV. More specifically, disclosed herein is a helmet system including an opaque ballistic rated visor that is attached to a helmet and that covers the wearer's eyes when attached to the helmet. Depending on the particular embodiment, the visor may include an opaque ballistic plate (and/or additional materials) to provide increased protection against threats such as high velocity rifles and armor piercing rounds. While the ballistic rated visor may be rated for any appropriate threat level, in one embodiment, the ballistic rated visor is rated for a threat level greater than or equal to NIJ threat level III.

In some instances, it may be desirable to provide a helmet system that is capable of being altered to suit a particular situation. In such an embodiment, a visor may be selectively removable from the helmet. The selective attachment of the visor to the helmet may be provided in any suitable fashion. For example, fastening arrangements may include, but are not limited to, mechanically interlocking features, bolts, clips, and latches, to name a few. While in some embodiments the visor is selectively removable from the helmet, it should be understood that in other embodiments, the visor may be either permanently connected or integrally formed with the helmet as the disclosure is not limited in this regard.

In certain situations, it is desirable to provide increased protection for a wearer's face. Accordingly, in one embodiment, the helmet system also includes a mandible guard either removably attached to, permanently attached to, or integrally formed with the helmet. The mandible guard may provide protection for a lower portion of a person's head, chin, cheeks, and/or face. In such an embodiment, the visor may be constructed and arranged such that it either attaches to, or is mounted flush against, the mandible guard. For example, the visor may have a lower surface that abuts against an upper surface of the mandible guard when both the visor and mandible guard are mounted to the helmet. Alternatively, in other embodiments, the visor may be sized and shaped to substantially cover a wearer's entire face including the cheeks, chin, and other appropriate portions of the face not covered by the helmet.

A wearer may wish to move a visor out of their line of sight without fully removing the visor from the helmet system in some embodiments, for example in instances where a person wishes to observe a larger field of view, increase a flow of fresh air into the helmet system, and/or other situations. In such an embodiment, the visor may be constructed and arranged such that is positionable in a first deployed position in a line of sight of a wearer. The wearer then may selectively move the visor between the first deployed position and a second undeployed position where the visor is out of the line of sight of the wearer while the visor remains attached to the helmet. For example, the visor may be positioned in front of a wearer's face and then moved to a position on top of the helmet when not in use. In one embodiment, various hinge arrangements and locking mechanisms may be used to rotate the visor between the deployed and undeployed positions. While a particular arrangement is discussed above, it should be understood that the current disclosure is not limited to any particular arrangement for moving the visor between the deployed and undeployed position, and that any suitable structure capable of accomplishing this desired functionality may be used.

In order to increase the ballistic protection and support of a visor relative to the helmet and/or mandible guard, in some embodiments, it may be desirable to place a rear surface of the visor facing a wearer against a suitable support surface of the helmet and/or mandible guard. In such an embodiment, the rear surface of the visor may be sized and shaped to abut against a support surface of the mandible guard and/or helmet. While this support surface may be an outer surface of the mandible guard and/or helmet, in some embodiments, the support surfaces of the mandible guard and/or helmet are recessed relative to the outer surfaces of the mandible guard and/or helmet. Without wishing to be bound by theory, recessing the support surfaces and the associated visor resting thereon may increase the ballistic protection offered by the combined helmet system.

In some embodiments, it is desirable to provide a line of sight through the visor covering a wearer's eyes to enable a wearer to either directly see out of the visor or to use a suitable optical system to see out of the visor. In such an embodiment, the visor includes one or more openings. In embodiments where an optical system is used, one or more components of the optical system may be positioned within the one or more openings. In one particular embodiment, the one or more openings are aligned with a wearer's eyes when the visor is attached to the helmet. However, it should be understood, that the openings may be sized, shaped, and positioned on the helmet in any suitable fashion to accommodate the components of any suitable optical system or to provide direct sight for a wearer. For example, in one embodiment, there are two openings separately aligned with each of a wearer's eyes, and each opening is approximately 3.8 inches in length and 1 inch in height, though any suitable sizes for length may be used.

Suitable optical systems that may be used with the currently described visors include, but are not limited to, monocular systems, binocular systems, quad optics systems, and other suitable systems. Additionally, these optical systems may include typical camera systems, night vision systems, infrared systems, or any other suitable visualization systems as the disclosure is not so limited. For example in one specific embodiment, the optical system may be a pair of GPNVG-18 night vision goggles with quad optics manufactured by L-3 Warrior Systems.

Various words such as contacting, attached, flush, abutting connecting, and other similar words are used in regards to the various components and their interactions as described herein. However, it should be understood that these terms do not require that the various components must be directly contacting, attached, flush, abutting, and/or connecting. Instead, it should be understood that various the various components described may be indirectly contacting, attached, flush, abutting, and/or connecting unless otherwise indicated.

Turning now to the figures, several non-limiting embodiments are described in further detail. It should be understood that the various features and components described in regards to the figures may be arranged in any desired combination and that the current disclosure is not limited to only those embodiments depicted in the figures. Further, for the sake of clarity, a particular helmet assembly including a separate helmet and detachable mandible guard has been depicted with the depicted visors. However, it should be understood that the depicted visors may be used with helmet assemblies including non-detachable mandible guards, helmet assemblies that do not include mandible guards, and/or any other suitable helmet assembly as the disclosure is not limited in this fashion.

Figure 2:
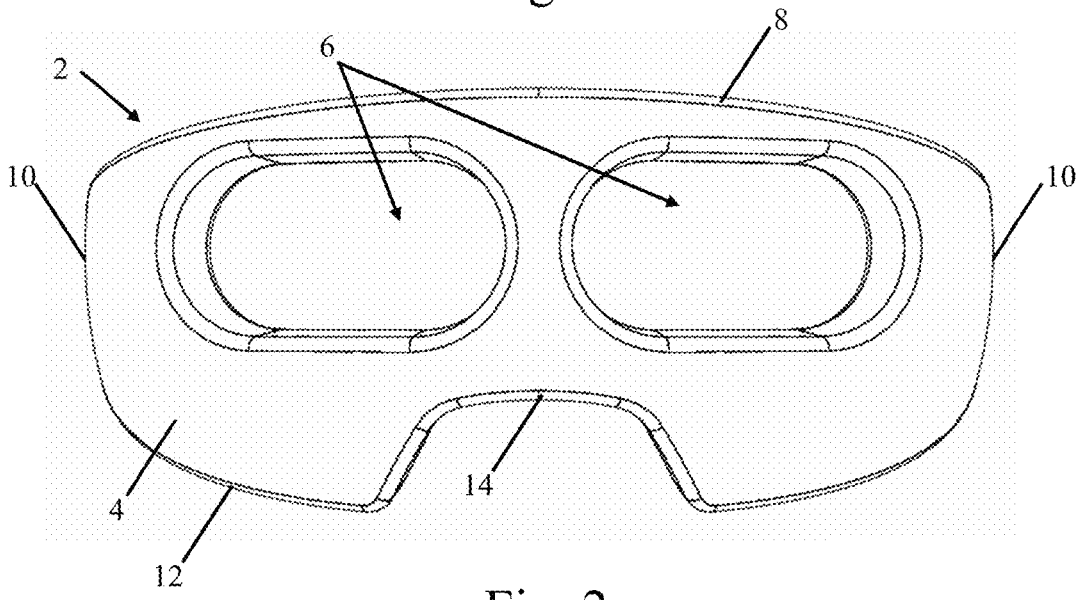
FIG. 2 is a schematic front view of a visor with openings configured to align with a wearer's eyes.

FIGS. 1 and 2 depict one embodiment of an opaque ballistic rated visor 2 used as part of a helmet system. Additionally, FIG. 1 shows the visor in combination with an associated helmet assembly 100 including a helmet 102 and a mandible guard 104 attached to the helmet. Depending on the embodiment, the helmet may include various accessories attached thereto such as a front mount 114 and/or a suitable carrier 116 such as the front mount system depicted in the figure. These various components and their interactions are described in more detail below.

In the depicted embodiment, the visor 2 includes a front surface 4*a* facing away from a wearer when attached to the helmet, and a rear surface 4*b* facing toward a wearer when attached to the helmet. The visor also includes an upper edge 8, two opposing side edges 10, and a lower edge 12. The top and side edges 8 and 10 of the visor are sized and shaped such that the visor substantially conforms to an opening 118 located along a lower edge of the helmet 102*a*. Additionally, in embodiments where the helmet assembly 100 includes a mandible guard 104, the visor 2 is sized and shaped to substantially conform to an opening 118 located between the lower edge of the helmet 102*a* and an upper surface of the mandible guard 112. For example, lower edge 12 of the visor may be sized and shaped such that it abuts against an upper surface 112 of the mandible guard 104. The contour followed by the lower edge 12 may include various features including, for example, a nose bridge 14 located on the visor to accommodate a corresponding nose bridge located on the uppers surface 112 of the mandible guard.

As noted above, in some embodiments, it is desirable to support the rear surface 4*b* of the visor using a suitable support surface to provide increased stability of the visor and increased ballistic protection for a wearer. Therefore, in some embodiments, a helmet assembly 100 may include one or more support surfaces located along various edges and surfaces of the helmet 102 and/or mandible guard 104. As depicted in FIG. 1, these support surfaces may include one or more recessed support surfaces extending along a lower edge of the helmet 102*a* surrounding a wearer's face and cheeks. For example, the helmet includes an upper mounting surface 106 and two support side support surfaces 108 located along the lower edge 102*a*. The depicted support surfaces are oriented such that they are parallel to the wearer's face and substantially conform to a shape of the corresponding portion of the rear surface 4*b* of the visor. A similar lower support surface 110 is located along an upper surface of the mandible guard 104. Accordingly, when the visor is located within the opening 118 between the helmet and mandible guard, at least a portion of the edges of the rear surface 4*b* of the visor are held flush against the corresponding mounting surfaces of the helmet and mandible guard. While several gaps are depicted between the support surfaces of the mandible guard and the helmet, it should be understood that in some embodiments, the support surfaces of the helmet and mandible guard may provide a substantially continuous support surface against which the visor's rear surface may be held. Additionally, while the support surfaces have been depicted as being parallel to the wearer's face, the support surfaces may be oriented at any suitable angle as the disclosure is not limited in this fashion. For example, the support surfaces may be angled outwardly.

As depicted in the figures, in some embodiments, the visor 2 includes one or more connectors 16 to either permanently or selectively attach the visor to the helmet assembly 100. In the depicted embodiment, the one or more connectors 16 are two flexible tabs located along an upper edge 8 of the visor that selectively attach to the lower edge of the helmet 102*a*. For example, upon insertion into the opening between the helmet 102 and the mandible guard 104, the flexible tabs corresponding to the connectors 16 are initially deflected downward prior to springing into a corresponding connecting portion located on the helmet, not shown. Depending on the particular embodiment, the tabs may be deflected downwards, or a sufficient force may be applied, to remove the visor 2 from the helmet assembly 100. While two connectors located along an upper edge of the visor has been depicted in the figures, it should be understood that any number of connectors located along any one of the edges and surfaces of the visor may be used to connect the visor to the helmet assembly. Additionally, while flexible tabs have been depicted, other suitable attachment arrangements including, but not limited to, bolts, latches, clips, as well as mechanical interlocking features may be used as the disclosure is not so limited.

Figure 4:
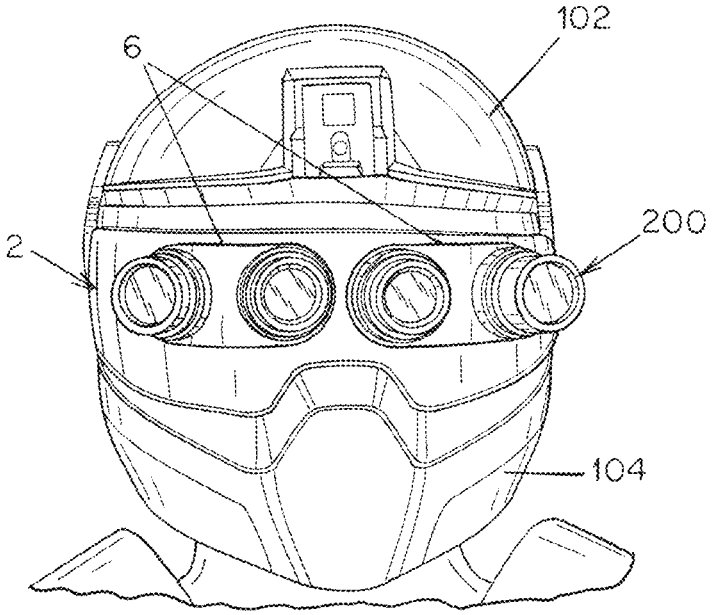
FIG. 4 is a schematic front view of an assembled visor, helmet assembly, and optical system.
Figure 5:
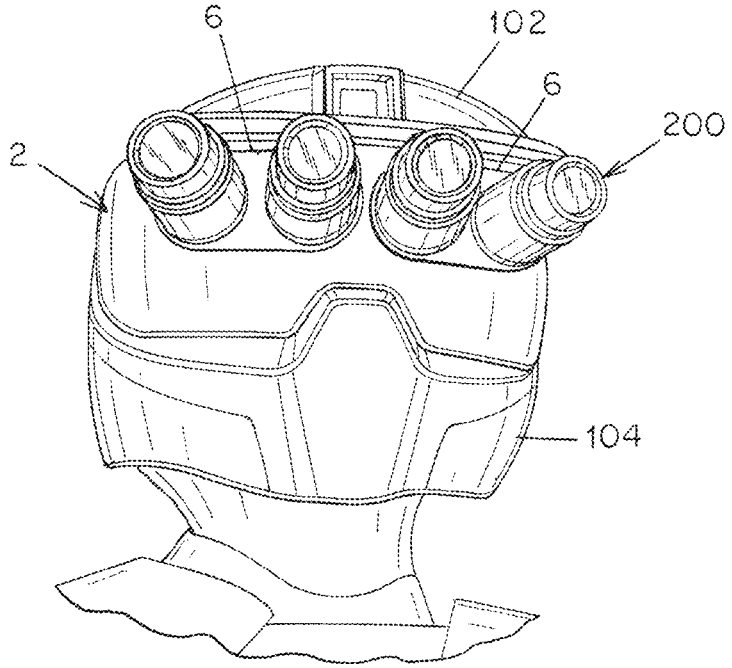
FIG. 5 is a schematic perspective view of an assembled visor, helmet assembly, and optical system.

As best illustrated in FIG. 2, in some embodiments, the visor includes one or more openings 6 that pass from the front surface 4*a* of the visor to the rear surface 4*b* of the visor. For example as depicted in the figure, there may be two openings in the visor. However, any suitable number of openings may be used. In addition to the above, in some embodiments, the openings are aligned with a wearer's eyes when the visor is attached to the helmet, but embodiments in which the openings are not aligned with a wearer's eyes are also contemplated. Referring to FIGS. 4 and 5, the one or more openings 6 may be sized, shaped, and positioned on the helmet to accept one or more components of an optical system 200. In the depicted embodiment, the openings 6 are elongated ovals aligned with a wearer's eyes and have a length of approximately 3.8 inches and a height of approximately 1 inch for accepting the double optical barrels and other components, for a quad optic system in each opening. In some embodiments, each opening is at least 1 inch in length, while in other embodiments, each opening is at least 2 inches in length, or at least 3 inches in length. In some embodiments, each opening is at least 1 inch in height, or at least 1.5 inches in height.

Figure 3:
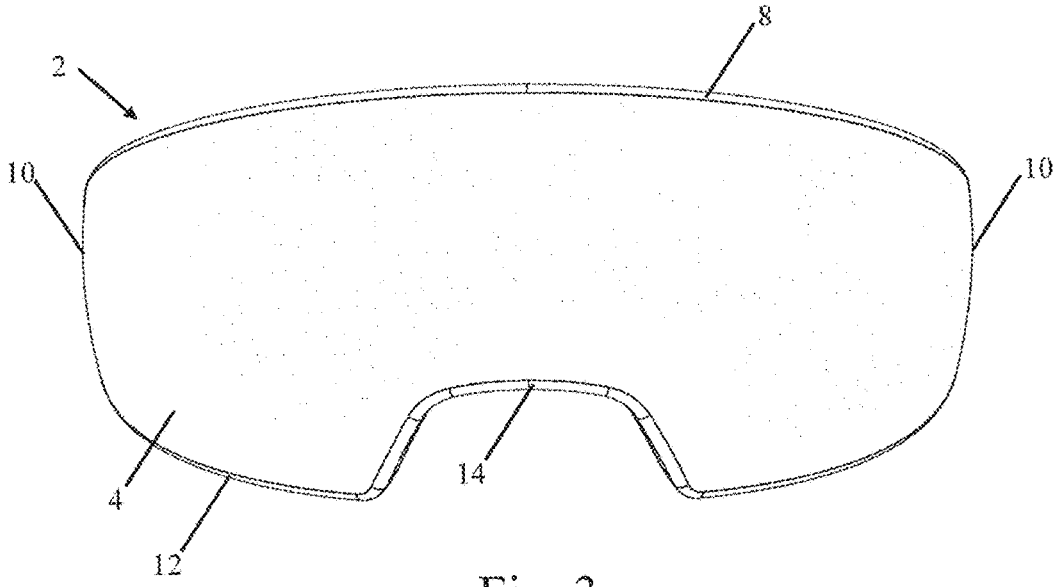
FIG. 3 is a schematic front view of a visor without openings.

While a particular optical system has been depicted, other suitable optical systems may be used including, but not limited to, monocular systems, binocular systems, and other suitable systems. Additionally, suitable optical systems may include typical camera systems, night vision systems, infrared systems, or any other suitable optical system as the disclosure is not so limited. For example, in the embodiment depicted in the figures, the optical system is a pair of GPNVG-18 night vision goggles with quad optics manufactured by L-3 Warrior Systems. While a visor with openings has been depicted in FIG. 2 and discussed above, embodiments in which a visor 2 does not include openings are also contemplated as illustrated in FIG. 3. In such embodiments, a camera or other optical components may be mounted on the exterior of the helmet and/or visor, and a display may be provided within the interior of the helmet to provide views of the environment to the wearer.

Having described the various components and their interactions, a method of using the illustrated helmet system is now described. In one particular embodiment, an opaque, ballistic rated visor is attached to a helmet such that it covers a wearer's eyes. Depending on the particular embodiment, the visor may either be permanently attached to the helmet, or the visor may be removably attached to the helmet such that it may be detached by a wearer when desired. When attaching the visor to the helmet, a wearer may also abut a lower edge of the visor against an upper surface of a mandible guard and position a rear surface of the visor facing the wearer against one or more support surfaces located on the helmet and/or mandible guard. Positioning the rear surface of the visor on the support surfaces may also include positioning at least a portion of the visor within a recess corresponding to the one or more support surfaces. Depending on the particular embodiment, in instances where the wearer wishes to only partly remove the visor, the wearer may selectively move the visor between a first deployed position in the line of sight of the wearer and a second undeployed position out of the line of sight of the wearer. For example, the wearer may rotate the visor from in front of their face to a position located on top of the helmet. The visor may be attached to a front mount on the helmet in some embodiments. In other embodiments, the visor may be pivotally or otherwise movably attached via its opposing side edges 10 to the helmet or mandible guard.

In embodiments where a visor includes one or more openings for accommodating an optical system, a wearer may position one or more components of the optical system within the openings. Depending on the particular arrangements of the optical system, the optical components may be positioned within the openings either prior to, or after attaching the visor to a helmet and/or mandible guard. Additionally, the optical system may either be connected directly to the visor, or it may be connected to the helmet as the disclosure is not so limited. For example, the optical system 200 depicted in FIGS. 4 and 5 is rotatably attached to the helmet 102 via front mount 114. Accordingly, the optical system 200 may be rotated between a lower position aligned with a wearer's eyes and an upper position located above a wearer's line of sight on top of the helmet. In such an embodiment, the optical system 200 is initially aligned with a wearer's eyes within the opening 118 located between the helmet 102 and mandible guard 104. The visor 2 is then attached to the helmet shell and/or the mandible guard with various components of the optical system 200 extending through the openings 6 in the visor. When desired, the visor is subsequently removed from the helmet prior to moving the optical system 200 to a position out of the line of sight of the wearer. While particular embodiments are described above, other arrangements of the optical system 200 and visor 2 are contemplated. For example, the various components of the optical system 200 located within the holes 6 may be permanently connected to the visor, or they may be positioned in the openings after the visor is attached to the helmet and/or mandible guard as the disclosure is not so limited.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A helmet system comprising:

an optically opaque ballistic visor attachable to a helmet, wherein the optically opaque ballistic visor includes an optically opaque ballistic plate and wherein the visor covers a wearer's eyes when attached to the helmet.

2. The helmet system of claim 1, wherein the visor is removable from the helmet.

3. The helmet system of claim 1, wherein the visor is selectively movable between a first, deployed position in a line of sight of a wearer, and a second, undeployed position out of the line of sight of the wearer.

4. The helmet system of claim 1, further comprising the helmet.

5. The helmet system of claim 1, wherein the visor has a lower surface that, when attached to the helmet, abuts against an upper surface of a mandible guard mounted to the helmet.

6. The helmet system of claim 5, further comprising the mandible guard.

7. The helmet system of claim 1, wherein a rear surface of the visor facing a wearer, when attached to the helmet, abuts against a first support surface of the helmet.

8. The helmet system of claim 7, wherein the rear surface of the visor facing the wearer when attached to the helmet abuts against a second support surface of a mandible guard.

9. The helmet system of claim 8, wherein the first support surface of the helmet is recessed relative to an outer surface of the helmet and the second support surface of the mandible guard is recessed relative to an outer surface of the mandible guard.

10. The helmet system of claim 1, wherein the visor includes one or more openings which are aligned with a wearer's eyes when the visor is attached to the helmet.

11. The helmet system of claim 1, wherein the visor includes one or more openings into which one or more components of an optical system can be positioned.

12. The helmet system of claim 11, further comprising the one or more components of the optical system.

13. The helmet system of claim 1, wherein the visor is sized and shaped to substantially cover a wearer's entire face.

14. A method comprising:

attaching an optically opaque ballistic visor to a helmet, wherein the optically opaque ballistic visor includes an optically opaque ballistic plate and wherein the visor covers a wearer's eyes when attached to the helmet.

15. The method of claim 14, further comprising positioning one or more components of an optical system in one or more openings in the visor.

16. The method of claim 14, further comprising selectively moving the visor between a first, deployed position in a line of sight of a wearer and a second, undeployed position out of the line of sight of the wearer.

17. The method of claim 14, further comprising placing a rear surface of the visor facing a wearer when attached to the helmet against a first support surface of the helmet.

18. The method of claim 17, further comprising placing the rear surface of the visor against a second support surface of a mandible guard.

19. The method of claim 18, wherein the first support surface of the helmet is recessed relative to an outer surface of the helmet and the second support surface of the mandible guard is recessed relative to an outer surface of the mandible guard.

20. The method of claim 14, further comprising detaching the visor from the helmet.

21. The helmet system of claim 8, further comprising the helmet and the mandible guard.

22. A helmet system comprising:

an optically opaque ballistic visor that is attachable to a helmet, wherein the visor covers a wearer's eyes when attached to the helmet, and wherein a rear surface of the visor facing a wearer when attached to the helmet abuts against a first support surface of the helmet, and wherein the rear surface of the visor facing the wearer when attached to the helmet abuts against a second support surface of a mandible guard.

23. The helmet system of claim 22, wherein the first support surface of the helmet is recessed relative to an outer surface of the helmet and the second support surface of the mandible guard is recessed relative to an outer surface of the mandible guard.

24. The helmet system of claim 22, further comprising the helmet and the mandible guard.

25. A helmet system comprising:

an optically opaque ballistic visor that is attachable to a helmet, wherein the visor covers a wearer's eyes when attached to the helmet, wherein the visor includes one or more openings which are aligned with the wearer's eyes when the visor is attached to the helmet.

26. The helmet system of claim 25, further comprising one or more components of an optical system positioned in the one or more openings.

27. The helmet system of claim 25, wherein the one or more openings are at least three inches in length and one inch in height.

28. The helmet system of claim 25, further comprising the helmet.

29. The helmet system of claim 1, wherein the visor is ballistic rated for a threat level greater than or equal to NIJ threat level IIA.

30. The method of claim 14, wherein the visor is ballistic rated for a threat level greater than or equal to NIJ threat level IIA.

31. The helmet system of claim 22, wherein the optically opaque ballistic visor includes an optically opaque ballistic plate.

32. The helmet system of claim 25, wherein the optically opaque ballistic visor includes an optically opaque ballistic plate.

* * * * *